US005628457A

United States Patent [19]

Mullick et al.

[11] Patent Number: 5,628,457

[45] Date of Patent: May 13, 1997

[54] DRINKING FOUNTAIN

[75] Inventors: Abir Mullick, Buffalo; William Cheung, Bronx; Jason C. Billig, Yonkers, all of N.Y.

[73] Assignee: Research Foundation of State University of New York, Albany, N.Y.

[21] Appl. No.: 406,135

[22] Filed: Mar. 20, 1995

[51] Int. Cl.[6] ..... E03B 9/20

[52] U.S. Cl. ..... 239/28; 239/24

[58] Field of Search ..... 239/16, 17, 24–29; 4/559, 567, 615

[56] References Cited

U.S. PATENT DOCUMENTS

| | | | |
|---|---|---|---|
| D. 239,284 | 3/1976 | Haws | D23/13 |
| D. 252,207 | 6/1979 | Haws et al. | D15/118 |
| D. 257,980 | 1/1981 | Sörensen | D15/118 |
| 1,338,474 | 4/1920 | Wuesthoff | 239/28 |
| 1,339,159 | 5/1920 | Blair | 239/28 |
| 3,329,345 | 7/1967 | Scott | 239/24 |
| 3,410,487 | 11/1968 | Hyde | 239/26 |
| 4,295,609 | 10/1981 | Brown, Jr. | 239/29 |
| 4,520,960 | 6/1985 | Cushman et al. | 239/29 |
| 4,590,628 | 5/1986 | DeGregorio | 239/25 |
| 4,597,525 | 7/1986 | Cushman et al. | 239/28 |
| 4,783,002 | 11/1988 | Raymer et al. | 239/29 |
| 5,458,288 | 10/1995 | Mullick et al. | 239/29 |

OTHER PUBLICATIONS

1986 Sweets Catalog File, Section 15, 7c/Eb, Ebco Mfg. Co., 1985, pp. 4–5.

"Water Coolers and Drinking Fountains" brochure, Elkay Manufacturing Company, 1994, pp. 1–39.

*Primary Examiner*—Andres Kashnikow
*Assistant Examiner*—Lisa Ann Douglas
*Attorney, Agent, or Firm*—Heslin & Rothenberg, P.C.

[57] ABSTRACT

The invention pertains to a combination of elements which allow a drinking fountain to be freely moveable within a range of positions. Mobility is achieved by supporting a fountain in cantilever fashion at the end of an arm which is mountable to a supporting structure in a manner which allows the arm to pivot relative to the supporting structure. A drinking fountain in accordance with the invention provides the advantage of being moveable, within its range of motion, to a position which provides optimal access and comfort to a user.

4 Claims, 12 Drawing Sheets

DRINKING FOUNTAIN

SUMMARY OF THE INVENTION

The invention pertains to a combination of means which allow a drinking fountain to be freely moveable within a range of positions. Mobility is achieved by supporting a fountain means in cantilever fashion at the end of an arm means which is mountable to a supporting structure in a manner which allows the arm to pivot relative to the supporting structure. A drinking fountain in accordance with the invention provides the advantage of being moveable, within its range of motion, to a position which provides optimal access and comfort to a user.

DETAILED DESCRIPTION OF THE INVENTION

The invention is comprised of a number of means which, in combination, provide the useful advantage described above. These include: fountain means, typically comprised of a basin, a water outlet, a drain, feed and drain lines, and valve means for controlling water flow; arm means for supporting the fountain means in cantilever fashion; pivotal mounting means for mounting the arm to a support structure in a manner which allows the arm to pivot relative to the support structure; range limiting means which limit the range of pivotal motion of the arm; and, adaptable coupling means which are capable of maintaining fluid communication between feed and drain lines within the arm and external to the arm throughout the range of motion of the arm. The invention may further include stabilizing means which operate to provide a counter-moment against the moment of the arm means and fountain means about the pivotal mounting means.

This disclosure first addresses individually the critical functions of each of the means which in combination comprise the invention, and describes the embodiments, and their equivalents, of each of these means which are presently contemplated by the inventors for fulfilling these functions. The disclosure then addresses two specific embodiments which are presently considered by the inventors to be the best modes for carrying out the invention in a free-standing and a wall-mounted form, respectively.

I Means which in Combination Comprise the Invention

A Fountain Means

The invention relates generally to those devices which are commonly referred to as drinking fountains. There are numerous drinking fountains disclosed in the prior art. For purposes of the present invention, the term fountain means will be used to refer to an apparatus or portion of an apparatus which comprises the components which are essential to a drinking fountain.

Figure 1:
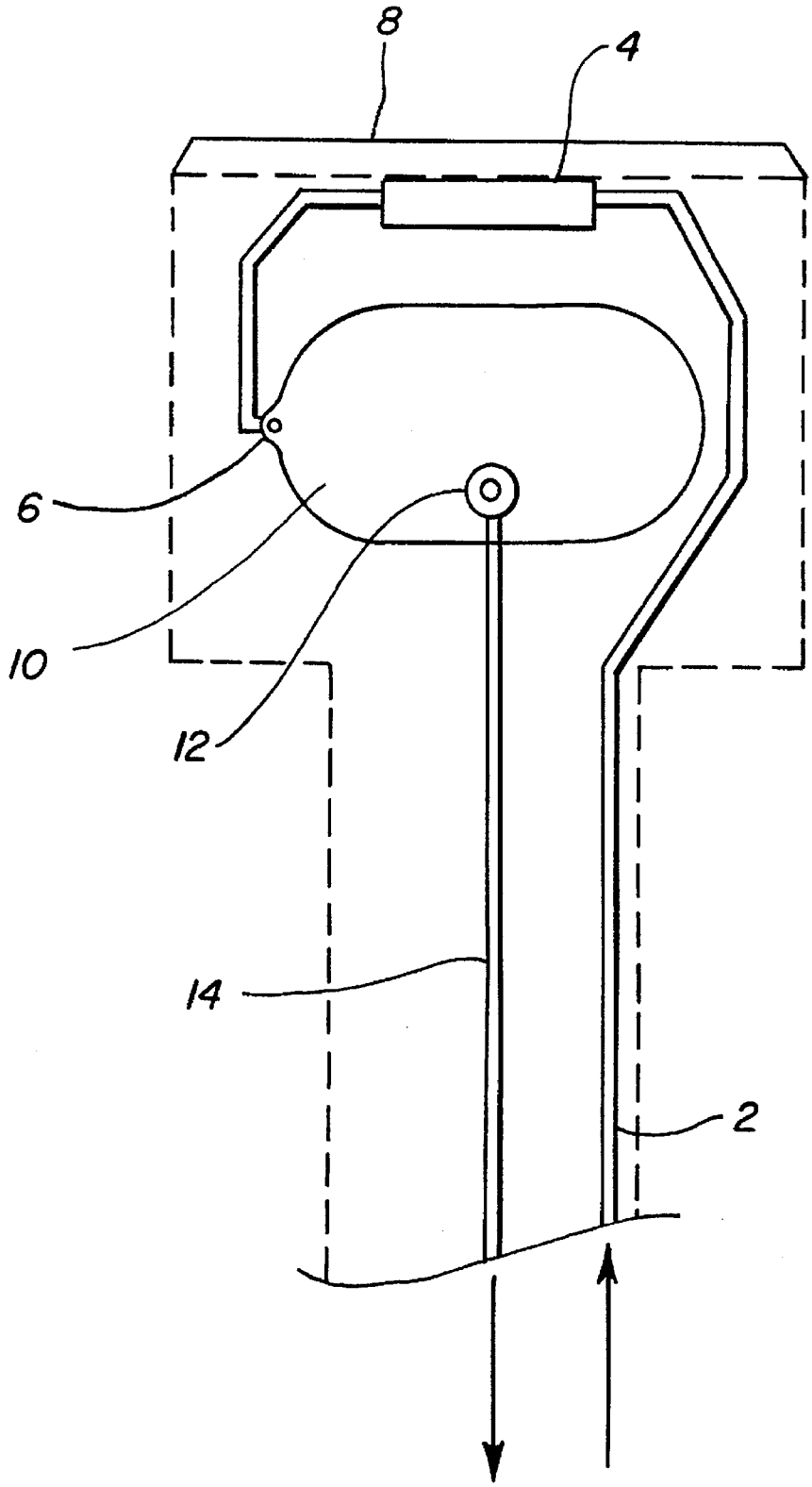
FIG. 1 A conceptual illustration of the essential components of a drinking fountain.

FIG. 1 provides a conceptual illustration of the essential components of a drinking fountain, shown within the context of a hypothetical structure which is indicated by broken lines. The essential components consist of a feed line 2 which supplies water by way of a valve means 4 to an outlet 6. The valve means 4 is operated by a control means 8. The control means may comprise, for example, an apparatus such as a rod or plunger by means of which the valve may be opened or closed. A variety of such control means are known in the art. The control means may be manipulated by a user by means of a button or bar attached to the control means to control the operation of the valve 4, and thereby the flow of water from the outlet 6. Water which exits the outlet 6 may be consumed by a user of the fountain. Any waste water is caught by a basin 10, which includes a drain means 12 in communication with a drain line 14. The drain line 14 conducts waste water away from the fountain. There are many known components which may be employed to collectively comprise a fountain means, and for the purposes of this disclosure, the inventors intend the term fountain means to be limited only by the range of known components and the configurations in which they may be so employed.

B Arm Means

Figure 2:
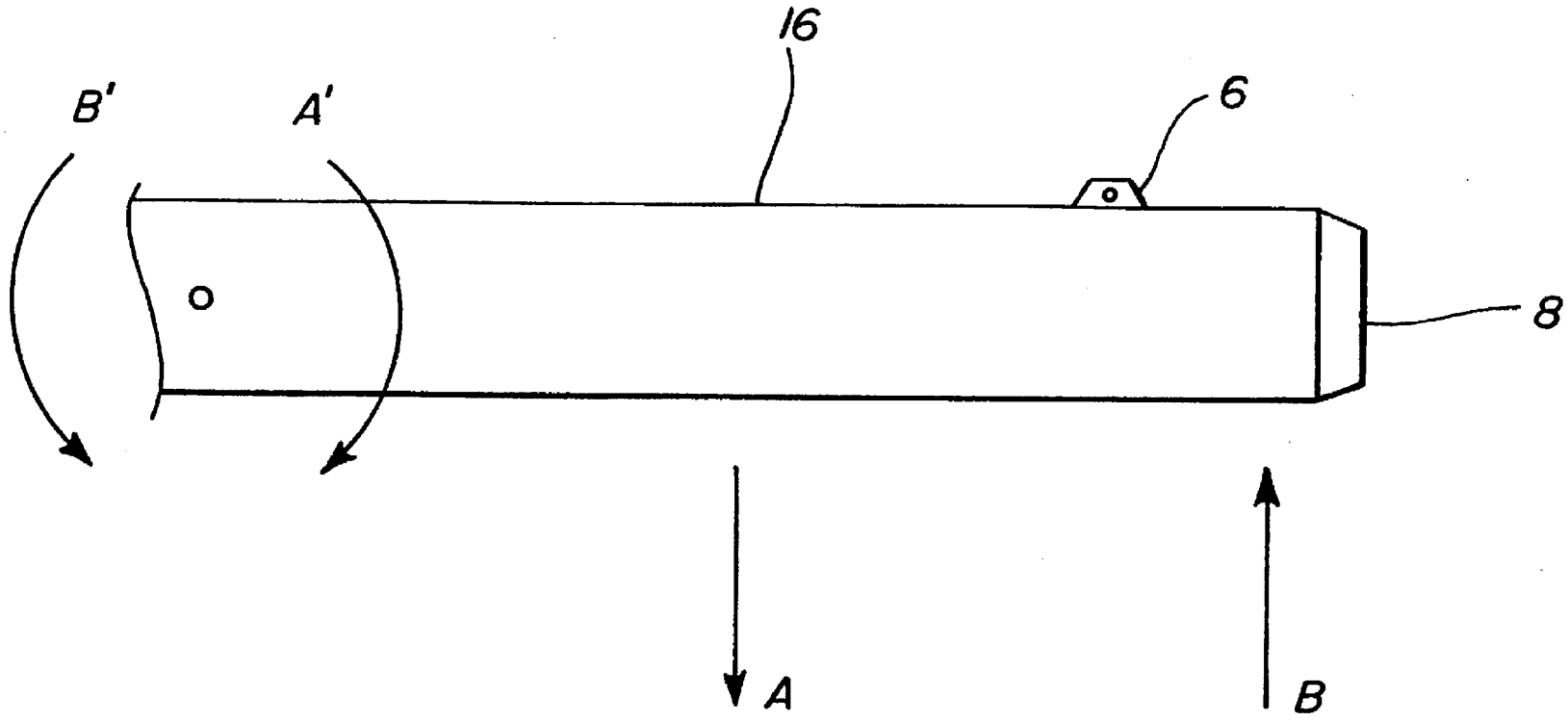
FIG. 2 A conceptual illustration of a fountain means supported in cantilever fashion by an arm means.

The invention relates specifically to those devices in which a fountain means is supported in cantilever fashion by an arm means. FIG. 2 provides a conceptual drawing of a fountain means which is integral with and supported in cantilever fashion by an arm means 16. The location of a control means 8 and an outlet 6 indicate that portion of the structure which comprises the fountain means. The arm means must be sufficiently strong and rigid to support its own weight and the weight of the fountain means. The combined weight of the fountain means and arm means result in a downward force A at the center of gravity of the structure.

It is recognized by the inventors that there are many known ways in which a fountain means may be adjoined to an arm means such that the fountain means is supported in cantilever fashion by the arm means. The methods and components which are employed to this end are matters of design choice. In describing the fountain means of the present invention as being supported by the arm means, the inventors intend the term supported to be limited only by the range of the known components and methods which may be employed toward that end.

C Pivotal Mounting Means

The invention relates specifically to those drinking fountains in which an arm which supports a fountain means is mounted to a support structure by means of a pivotal mounting means. The pivotal mounting means functions to provide an axis about which the arm and fountain means may pivot with respect to the support structure.

Figure 4:
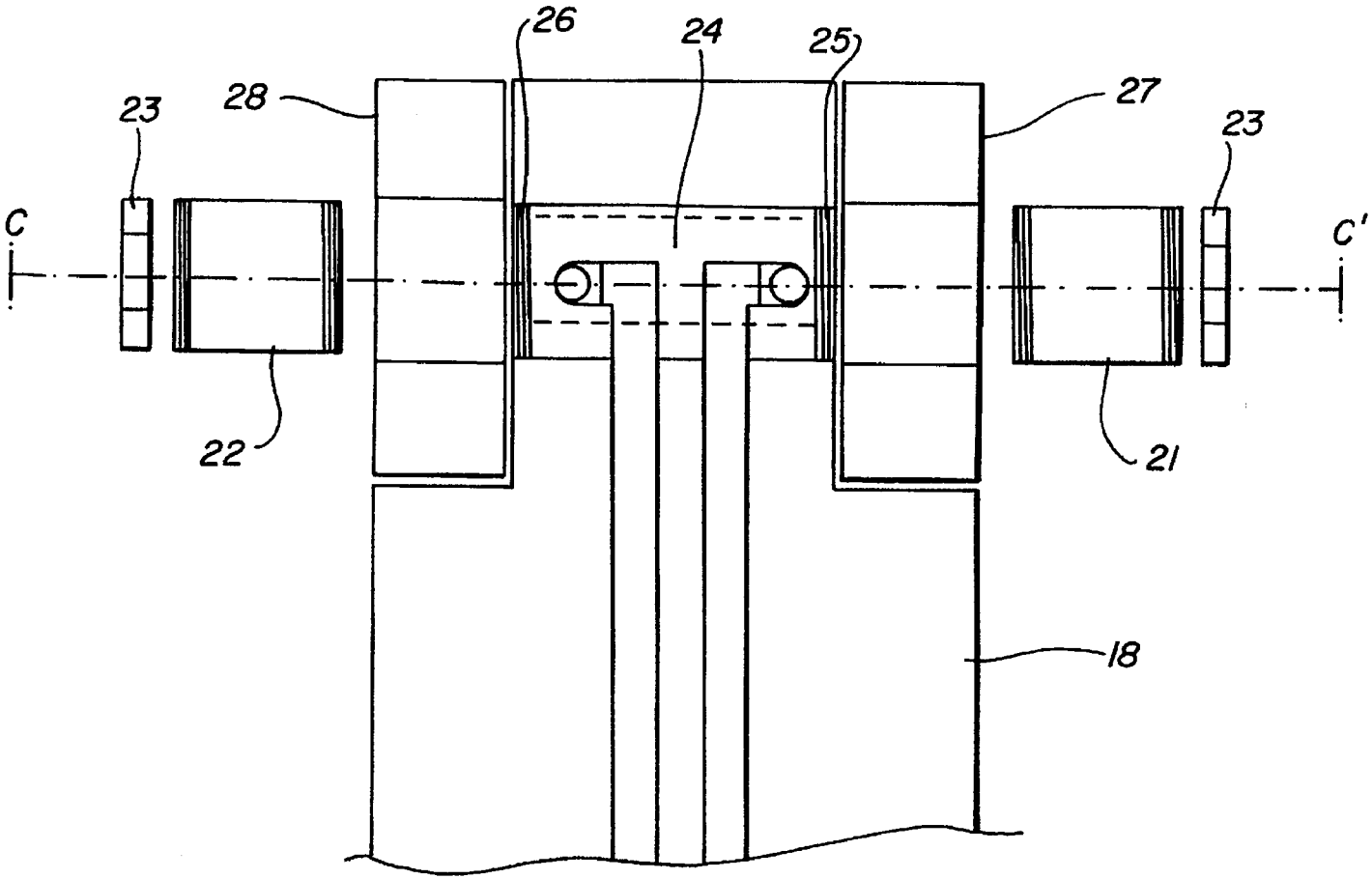
FIG. 4 A conceptual exploded cross-section view of a pivotal mounting means.

The conceptual illustration of FIG. 4 includes a first type of pivotal mounting means which may be employed in accordance with the invention. The figure shows an exploded cross-section of an arm means which is pivotally mounted to a support structure 18 by means of a hollow shaft comprised of threaded shaft segments 21 and 22. The support structure 18 includes a cylindrical aperture 24 having threaded ends 25 and 26. The arm means in the vicinity of the support structure is divided into two segments 27 and 28. The threaded shaft segments 21 and 22 may be passed through apertures 29 and 30 in the arm segments 27 and 28 and threaded into the support structure, thereby providing a shaft about which the arm means may pivot. Nuts 23 may be employed to secure the arm segments on the shaft.

Figure 5:
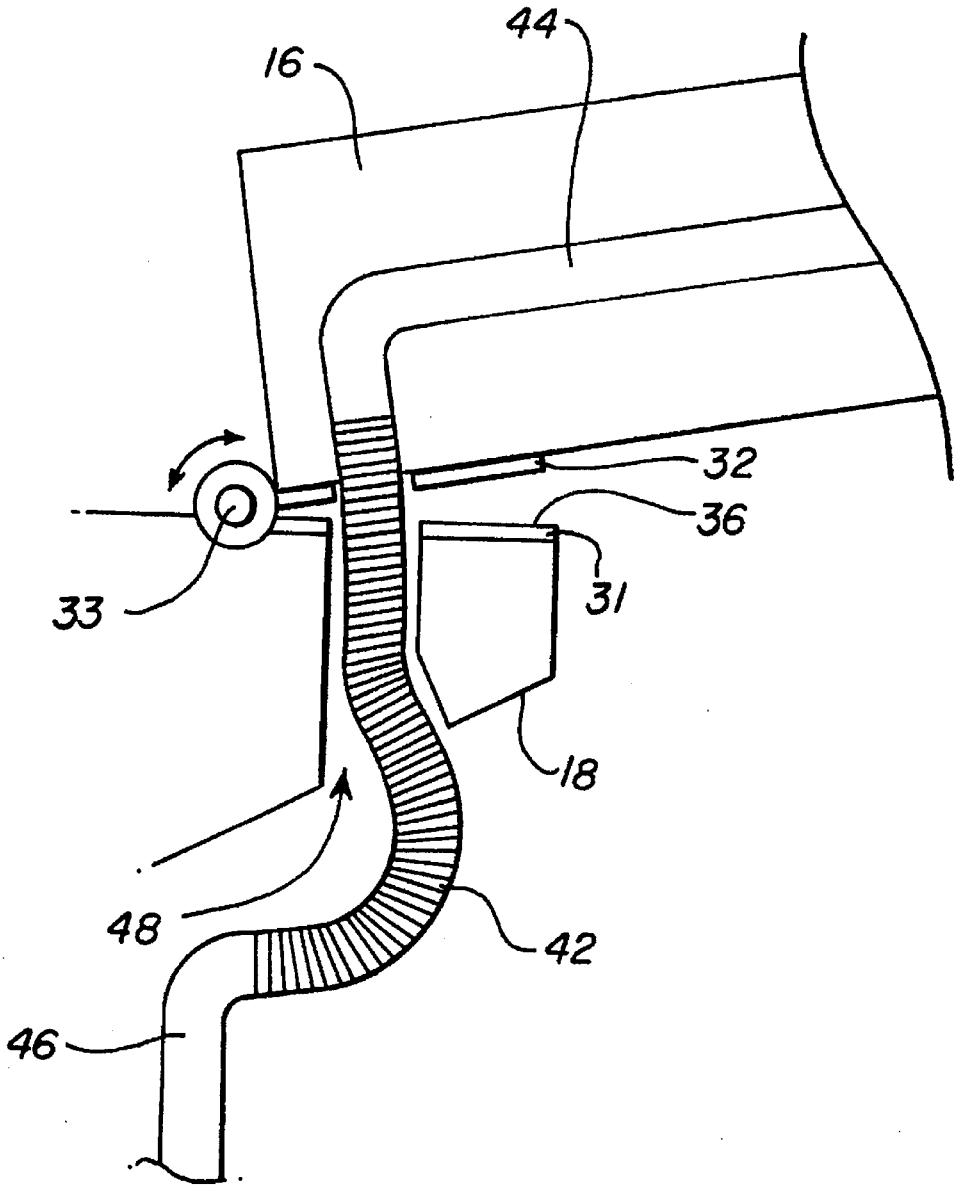
FIG. 5 A conceptual cross-section view of a hinge-type pivotal mounting means in combination with a flexible tube adaptable coupling means and range limiting means.

The conceptual illustration of FIG. 5 shows the use of a hinge-type pivotal mounting means which may be employed in accordance with the invention. Hinge plates 31 and 32 are pivotally joined by a hinge pin 33. A first hinge plate 31 is joined to a supporting structure 18 and a second hinge plate 32 is joined to an arm means 16. The hinge pin 33 thereby provides an axis about which the arm means may pivot relative to the support structure.

The critical function of the pivotal mounting means is to join the arm means and the support structure in a manner which allows the arm to pivot relative to the support structure. It is recognized by the inventors that there may be many additional obvious configurations of a shaft or hinge, and that there may as well be other known devices, which may be employed to provide a pivotal mounting means that performs this critical function. To the extent that such configurations and devices may be employed to perform this critical function, they are understood by the inventors to be equivalents of the embodiments disclosed herein.

E Range Limiting Means

It is desirable to limit the range of pivotal motion of an arm means which supports a fountain means. For example, it may be desirable that the arm means not tilt below the horizontal plane, since, depending on the orientation of the drain within the basin, drainage of water caught in the basin of the fountain means may be inhibited.

Range limitation may be achieved by providing a bearing surface within the rotational plane of the arm means at a point at which it is desirable that movement of the arm means be prevented. Referring again to the conceptual illustration of FIG. 5, the support structure 18 acts generally as a range limiting means 36, with the hinge plate 31 acting as the actual surface which prevents movement beyond that point. It can be readily seen that this will prevent the arm means 16 from tilting below the horizontal plane. It may be desirable that the range limiting means be integral with the support structure, since the latter will typically possess the physical characteristics necessary to support the weight of the arm means and fountain means. Range limiting means may be similarly employed to limit the range of the upward motion of the arm means where this is found to be desirable.

F Adaptable Coupling Means

As described above, a fountain means includes a feed line for supplying water and a drain line for conducting waste water away from the fountain. In the present invention, these lines must be capable of maintaining fluid communication between feed and drain lines associated with and external to the arm means throughout the range of motion of the arm means. This function is performed through the use of adaptable coupling means which couple the feed and drain lines located within the arm means to their counterparts outside of the arm means. The adaptable coupling means operate either to pivot or flex in coordination with the movement of the arm means.

Referring again to the conceptual illustration of FIG. 5, an adaptable coupling means 42 consisting of a length of flexible tubing provides fluid communication between a line 44 within the arm means and its counterpart line 46 outside of the arm means. The tubing may be flexible in the manner of simple rubber hosing, or may be of the type which is both flexible and expansible. The flexible tubing 42 passes through an aperture 48 in the support structure 18 and hinge plates 31 and 32. The length of the tubing 42 is chosen such that it can accommodate the desired range of motion of the arm means. A pair of such tubes in like orientation will provide adaptable coupling means for the feed and drain lines of the fountain means.

Figure 6:
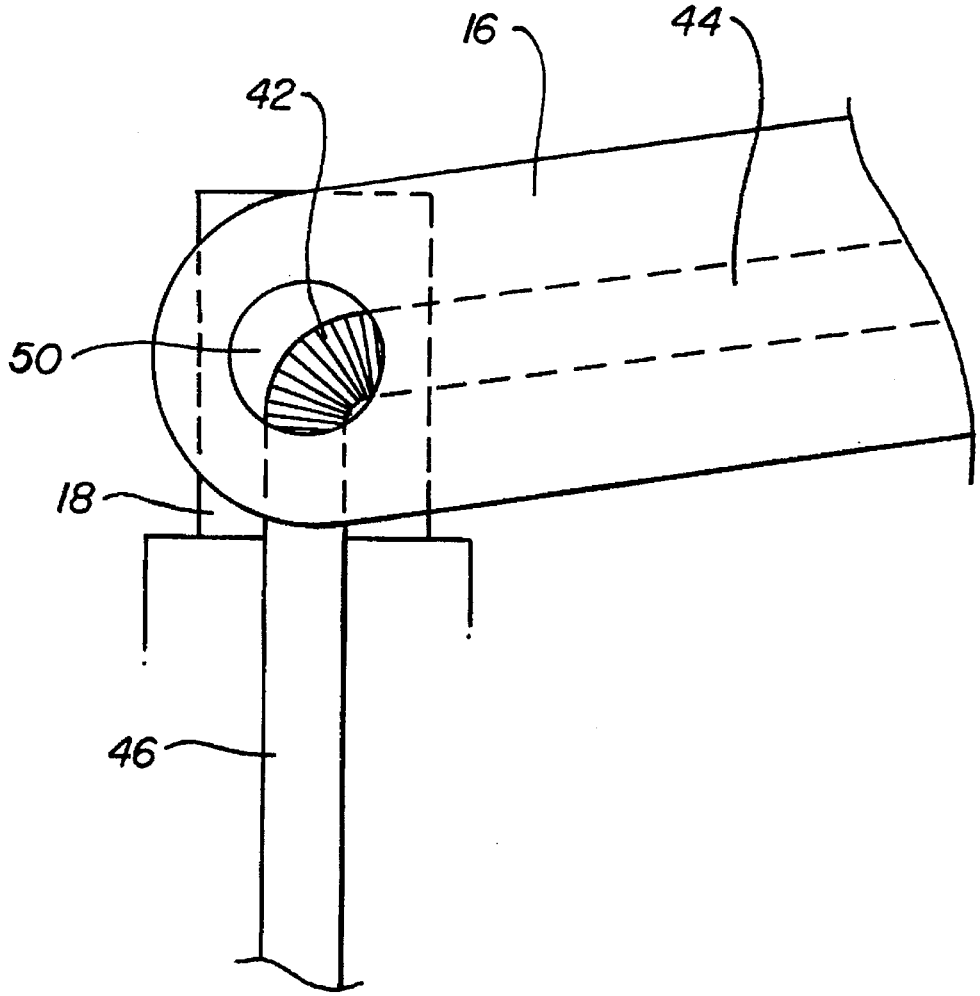
FIG. 6 A conceptual cross-section view of a shaft-type pivotal mounting means in combination with a flexible tube adaptable coupling means and range limiting means.

The conceptual illustration of FIG. 6 shows a second manner in which flexible tubing may be employed as an adaptable coupling means. This embodiment utilizes a hollow shaft 52 for a pivotal mounting means, as previously described in relation to the illustration of FIG. 4. Within the support structure is located a line 46 which is coupled by means of a length of flexible tubing 42 to a line 44 located within the arm means 16. The flexible tubing passes into the arm means from the support structure through apertures located therein. The aperture of the support structure is indicated by broken lines in FIG. 4. The flexible tube operates as an adaptable coupling means which is capable of movement throughout the range of movement of the arm means.

Figure 7:
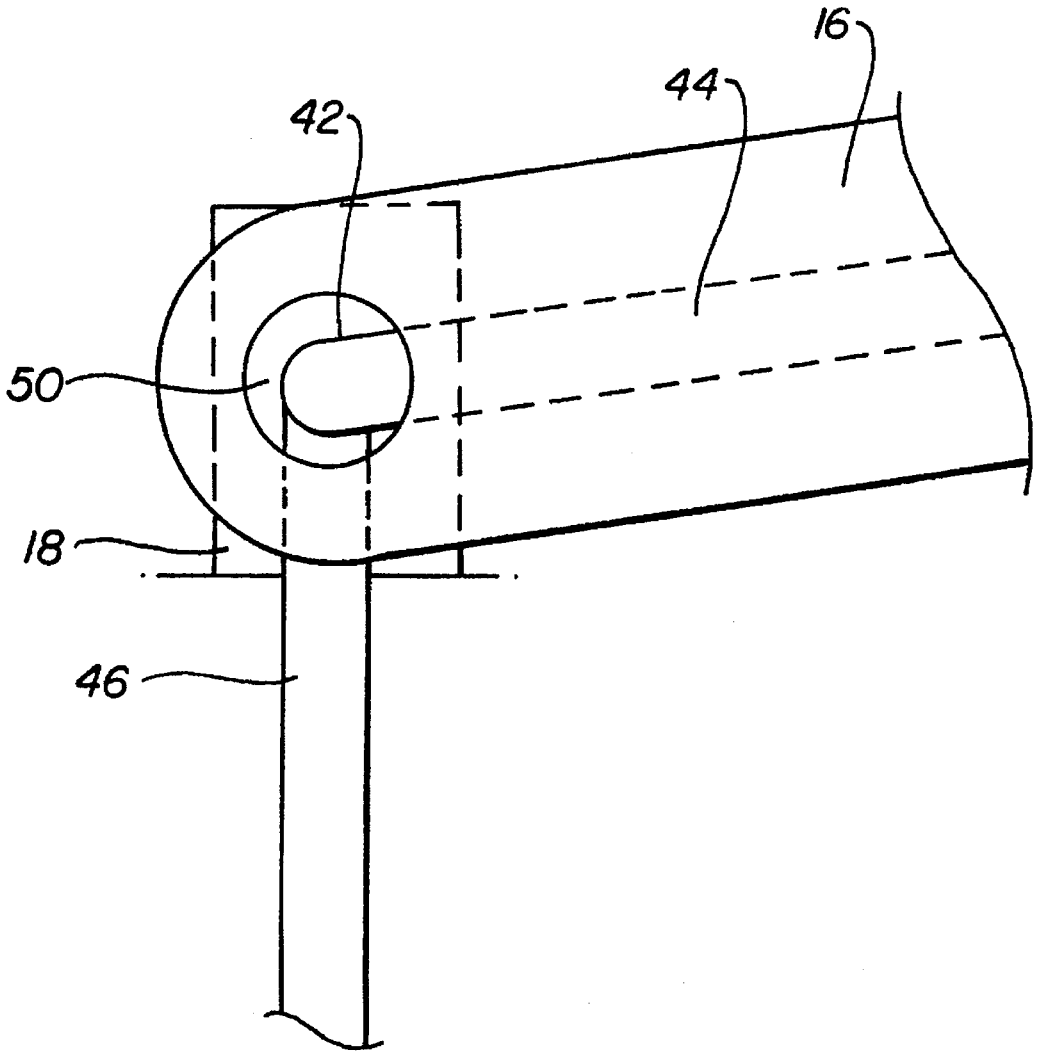
FIG. 7 A conceptual cross-section view of a shaft-type pivotal mounting means in combination with a pivotal coupling adaptable coupling means and range limiting means.

The conceptual drawing of FIG. 7 shows the use of a pivotal coupling, of which many are well known, as an adaptable coupling means. This embodiment utilizes a hollow shaft 52 for a pivotal mounting means, as previously described in relation to the illustration of FIG. 4. Within the support structure is located a line 46 which is coupled by means of a pivotal coupling means 42 to a line 44 located within the arm means 16. The line 46 passes into the hollow shaft by means of an aperture (not shown). The line 44 passes into the hollow shaft through an aperture as indicated by broken lines in FIG. 4. The coupling is located so that it is pivotally coaxial with the rotation of the arm means about the shaft, as indicated by line C–C' in FIG. 4. The pivotal coupling thereby operates as an adaptable coupling means which is capable of movement throughout the range of movement of the arm means.

The critical function of the adaptable coupling means is to pivot or flex in coordination with the movement of the arm means, thereby maintaining fluid communication between the feed and drain lines associated with and external to the arm means throughout its range of motion. It is recognized by the inventors that there may be many additional obvious configurations of a flexible tube or pivotal coupling means, and that there may as well be other known devices, which may be employed to provide an adaptable coupling means which performs this critical function. To the extent that such configurations and devices perform this critical function, they are understood by the inventors to be equivalents of the embodiments disclosed herein.

G Stabilizing Means

While not an essential element of the invention, is has been found to be desirable to provide a stabilizing means in combination with the elements recited heretofore. The stabilizing means is a component which operates to counteract the weight of the arm means and fountain means and the moment which their weight creates about the pivotal mounting means. Referring again to FIG. 2, a user of the fountain who wishes to move the fountain must apply a force B which is sufficient to create a moment B' about the pivot point such that B'>A'. The stabilizing means operates to create a moment having a direction which is the same as B', thereby lessening or eliminating the force B which a user must exert to raise the fountain.

Figure 8:
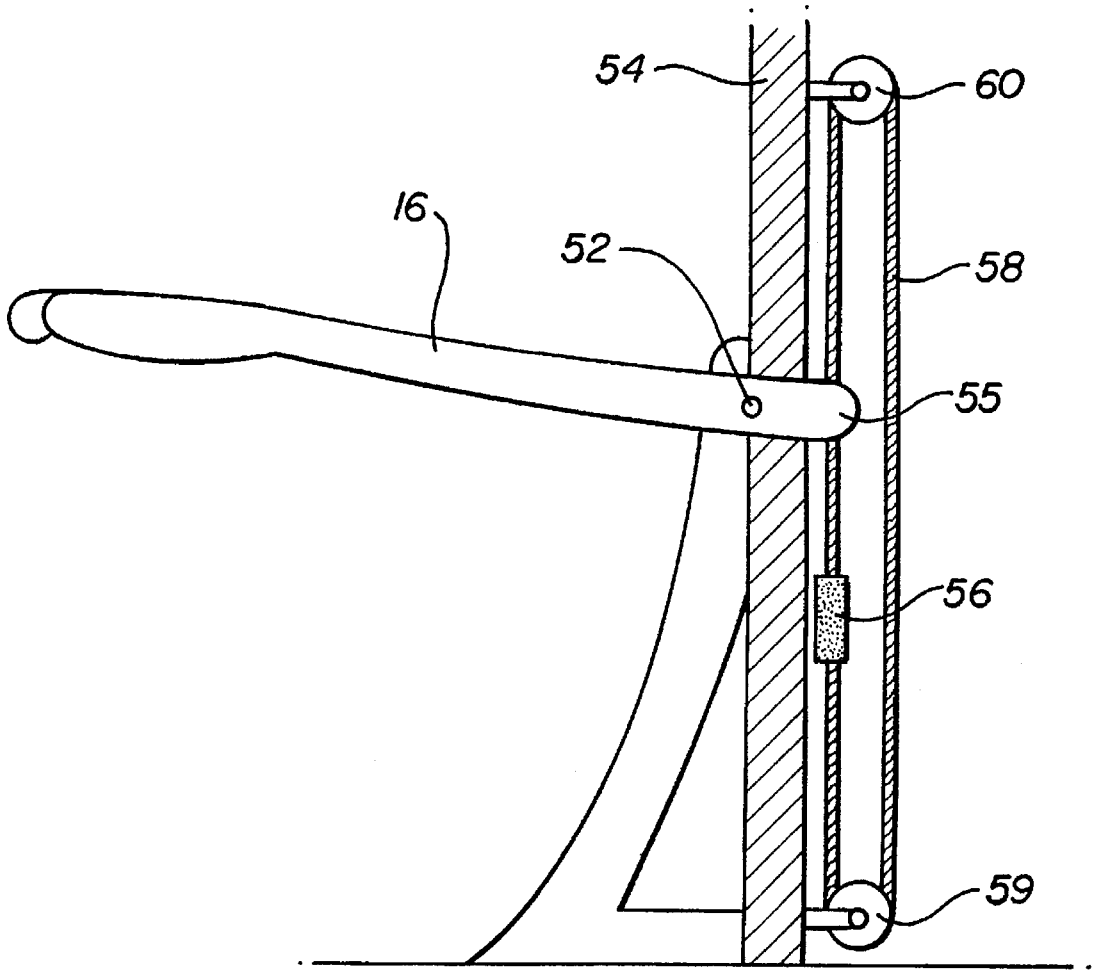
FIG. 8 A side view cross-section of a wall-mounted embodiment of the invention, including stabilizing means.

A first example of stabilizing means is provided in FIG. 8, in which a wall-mounted fountain having an arm means 16 pivots around a shaft 52 and extends through a wall 54. Behind the wall, a weight 56 is suspended on a rope 58 which travels about pulleys 59 and 60. The rope is joined to the end 55 of the arm means which is disposed behind the wall. In this manner, the force from the weight is conveyed to the end 55 of the arm means, thereby creating a moment about the shaft which counteracts the moment created by the weight of the arm means 16 and the associated fountain means.

Figure 3:
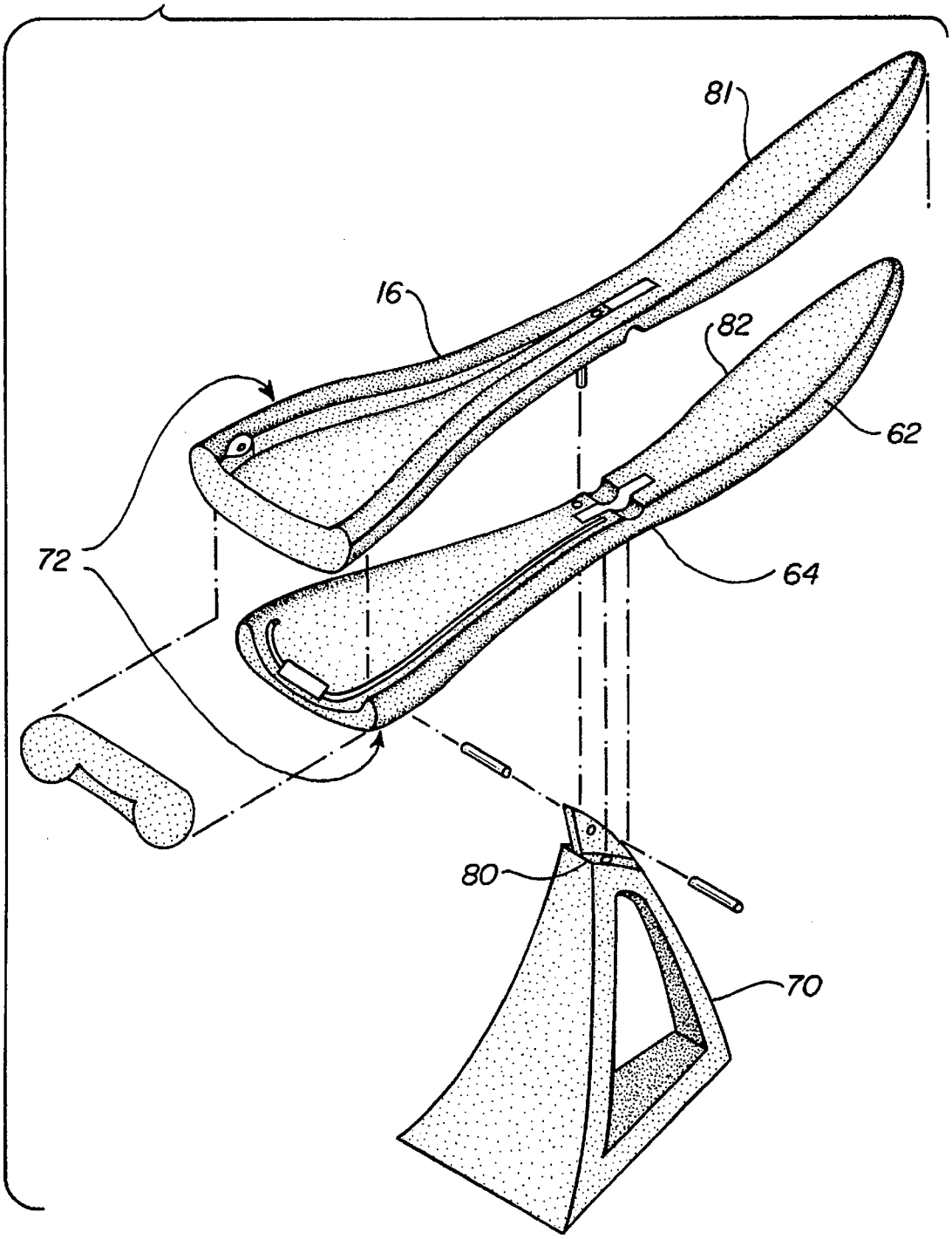
FIG. 3 An exploded view of a free-standing embodiment of the invention, including stabilizing means.
Figure 14:
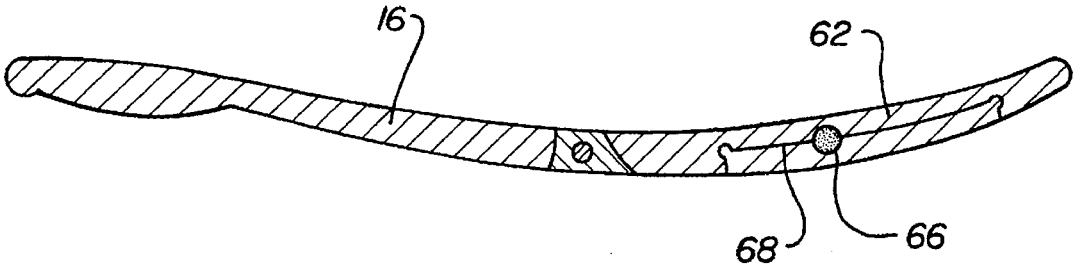
FIG. 14 A cross-section of an arm means integral with a stabilizing arm, including a moveable weight.

A second example of a stabilizing means is provided in figure 3, which illustrates a free-standing embodiment of the invention. Stabilization is provided by a stabilizing arm 62 which is integral with the arm 16 and fountain means and extends from a pivot point 64 in the opposite direction from the arm means 16. By providing a stabilizing arm which has approximately the same weight and weight distribution as the arm means and fountain means, near balance may be achieved. The operation of the stabilizing arm may be further enhanced by providing a moveable weight within the stabilizing arm. FIG. 14 shows a cross-section of a stabilizing arm 62 which is integral with an arm means 16 and fountain means. A weight 66 traveling on a curved rod 68 will move as the arm means and fountain means are moved upward, thereby adjusting the weight distribution within the stabilizing arm. The curvature of the rod and the mass of the weight are chosen in accordance with the shape and weight distribution of the fountain means, arm means, and stabilizing arm.

The inventors foresee that there will be many other components whose incorporation into the invention to function as stabilizing means will be obvious. For example, it is likely that coil springs could be employed in manners which stabilize the fountain. The critical function of the stabilizing means is to create a moment about the pivot point of the arm means which counters the moment created by the weight of the arm means and fountain means. To the extent that other known devices or obvious configurations of known devices may be employed to perform this critical function, they are understood by the inventors to be equivalents of the embodiments disclosed herein.

II First Preferred Embodiment: Free-standing Drinking Fountain

Figure 9:
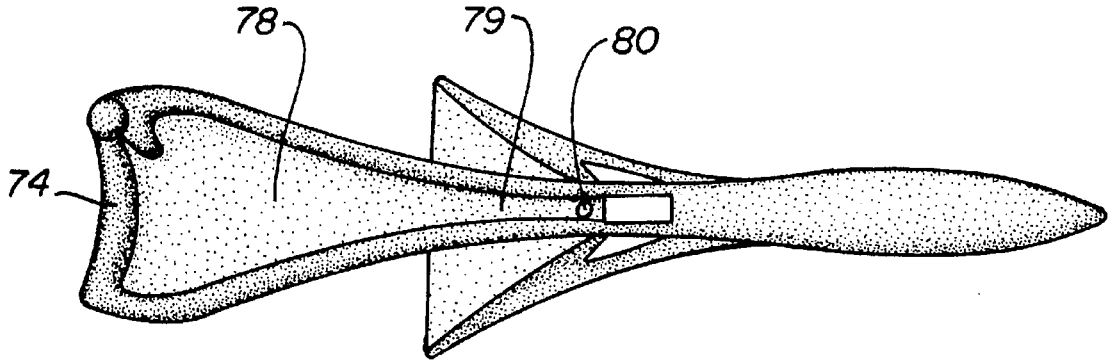
FIG. 9 A top view of a free-standing embodiment of the invention.
Figure 10:
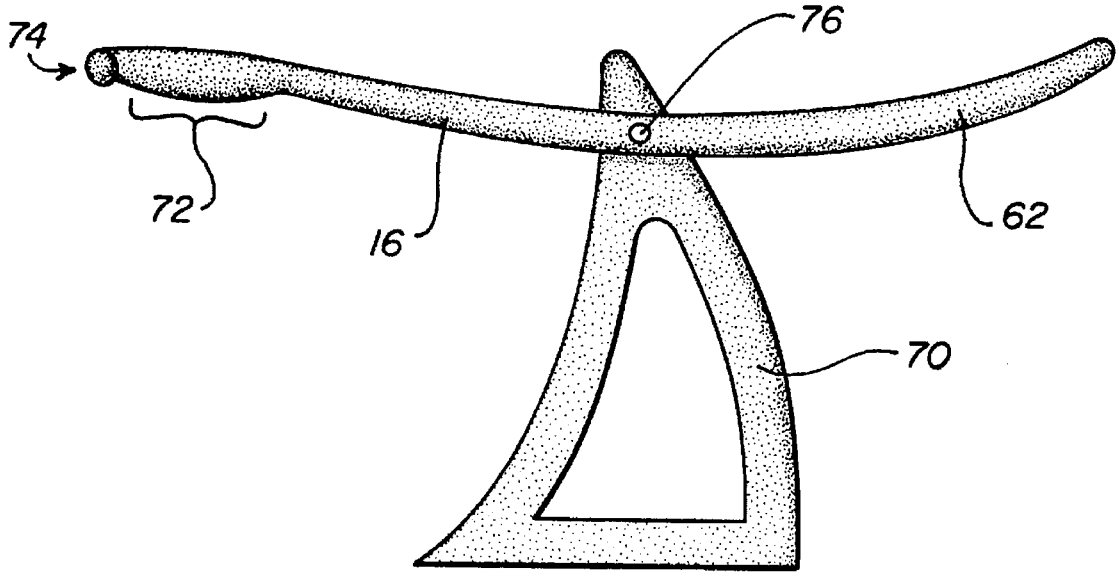
FIG. 10 A side view of a free-standing embodiment of the invention.

FIG. 3 and FIGS. 9 through 13 illustrate a preferred embodiment of the invention in a free-standing drinking fountain. Referring to FIG. 10, a pedestal 70 supports an arm means 16 which in turn supports a fountain means 72. The fountain means has a slim vertical profile, allowing for easy wheelchair access, and employs a control bar 74 situated at the forewardmost frontal edge of the fountain means, in accordance with the disclosure of the parent application. The arm means pivots about a shaft 76 and is integral with a stabilizing arm 62 which counterbalances the weight of the arm means and fountain means. The arm means has a slight upward curvature which ensures that water in the basin will not collect at the front of the basin.

Referring to FIG. 9, the basin 78 of the fountain means extends rearward from the control bar, narrowing to a trough which terminates at a drain means 80 located forward of the shaft 76. Because the curvature of the arm means prevents the fountain means from tilting below the horizontal plane, gravity will cause waste water to flow through the trough 79 toward the drain 80.

Figure 15:
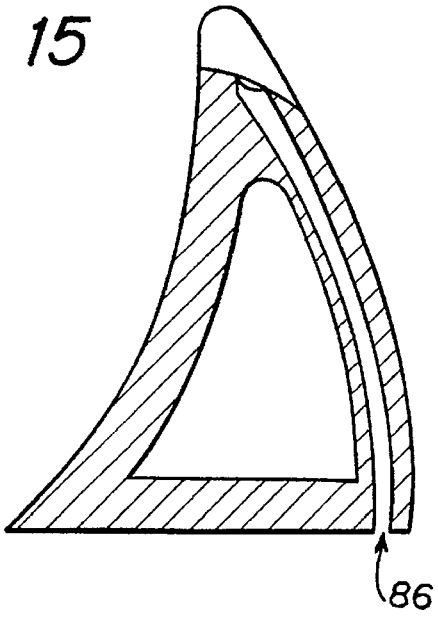
FIG. 15 A cross-section of a pedestal for a free-standing embodiment of the invention.

Referring to FIG. 3, the integral arm means 16, fountain means 72, and stabilizing arm 62 may be fabricated in the form of two complimentary shells 81 and 82 which are joined to form a single integral piece. FIG. 3 also illustrates a range limiting means 80 which is integral with the pedestal 70. FIG. 15 shows a cross-section of the pedestal 70 which reveals a cavity through which a feed or drain line may be provided.

Figure 11:
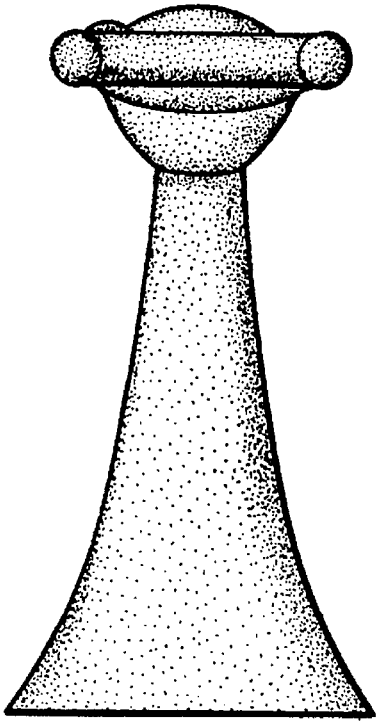
FIG. 11 A front view of a free-standing embodiment of the invention.
Figure 12:
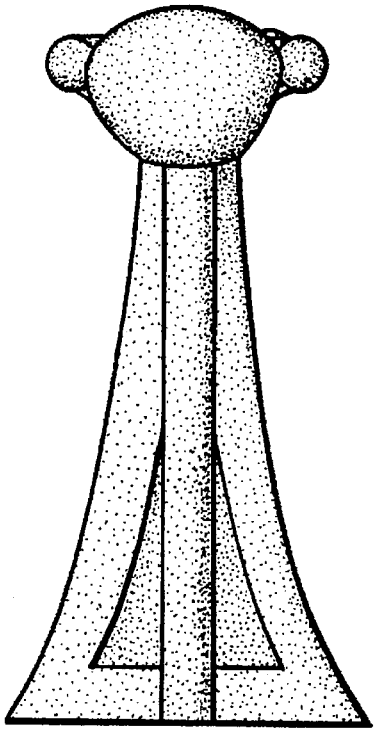
FIG. 12 A rear view of a free-standing embodiment of the invention.
Figure 13:
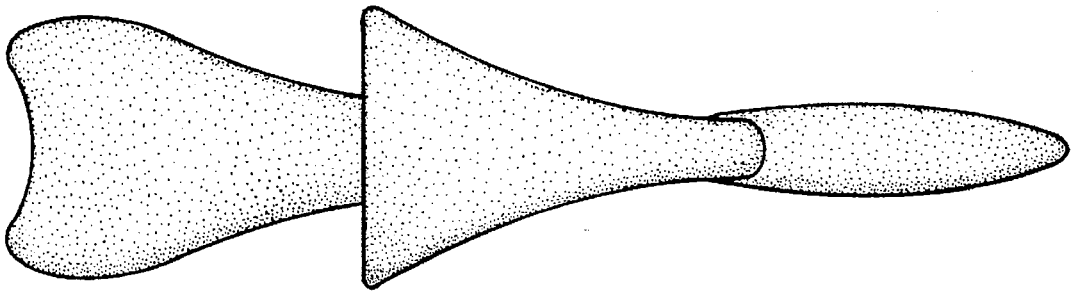
FIG. 13 A bottom view of a free-standing embodiment of the invention.

Front and rear views of this embodiment are presented in FIGS. 11 and 12, respectively, and a bottom view is presented in FIG. 13. Those aspects of the shapes and contours of this embodiment which are not dictated entirely by functional considerations were created specifically for their ornamental appeal.

III Second Preferred Embodiment: Wall-mounted Drinking Fountain

Figure 16:
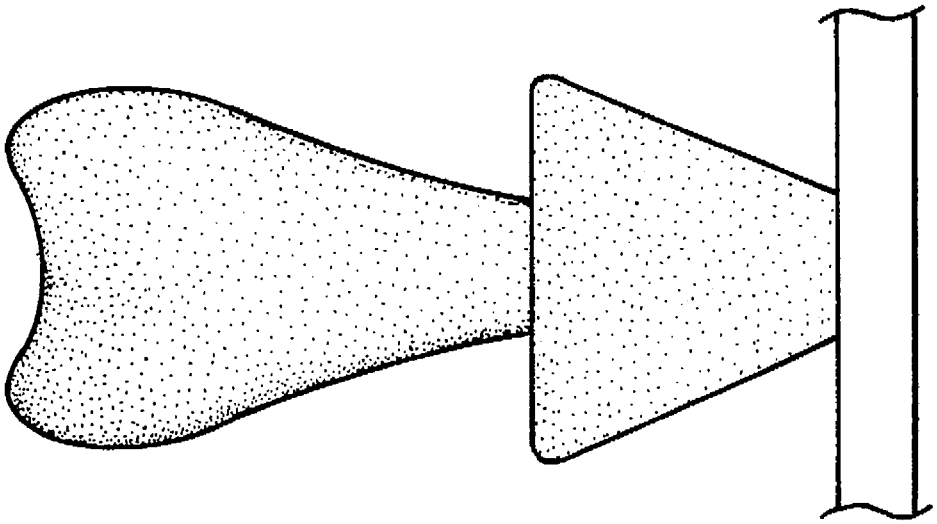
FIG. 16 A bottom view of a wall-mounted embodiment of the invention.
Figure 17:
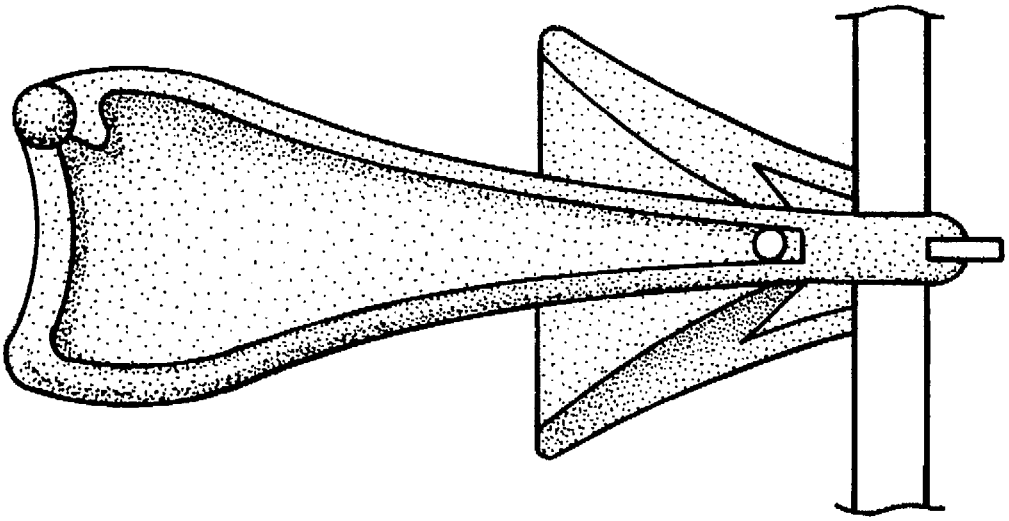
FIG. 17 A top view of a wall-mounted embodiment of the invention.

FIGS. 8, 16 and 17 present illustrations of a preferred embodiment of the invention in a wall-mounted fountain. This embodiment may be regarded as a variation on the free-standing embodiment, in which a concealed weight and pulley system as described above has been substituted for the stabilizing arm. FIGS. 16 and 17 present bottom and top views of the invention, respectively.

What is claimed is:

1. A drinking fountain comprising:

a basin having a drain line in communication therewith for conducting waste water from said basin;

an outlet associated in a fixed relationship with said basin for providing a stream of water to said basin;

a feed line for conducting water to said outlet;

an arm supporting said basin at a first end of said arm;

means for providing a vertically pivotal coupling between a second end of said arm and a supporting structure;

means for providing fluid communication between said feed line and a feed line external to said fountain through a range of motion of said arm; and means for providing fluid communication between said drain line and a drain line external to said fountain through a range of motion of said arm.

2. The apparatus of claim 1, further comprising:

means for limiting said range of motion of said arm.

3. The apparatus of claim 1, wherein said supporting structure comprises a pedestal.

4. The apparatus of claim 1, further comprising:

means for generating a moment about said means for providing vertically pivotal coupling mounting means which is counter to a moment of said arm means and said fountain means about said means for providing vertically pivotal coupling.

* * * * *